US006279435B1

(12) United States Patent
Zayat, Jr.

(10) Patent No.: US 6,279,435 B1
(45) Date of Patent: Aug. 28, 2001

(54) FOLDING TOOL

(76) Inventor: Charles D. Zayat, Jr., 129B Fletcher Ave., Cranston, RI (US) 02920

( * ) Notice: Subject to any disclaimer, the term of this patent is extended or adjusted under 35 U.S.C. 154(b) by 0 days.

(21) Appl. No.: 09/443,756

(22) Filed: Nov. 22, 1999

(51) Int. Cl.[7] ..... B25B 23/00
(52) U.S. Cl. ..... 81/440; 81/177.7; 81/177.4
(58) Field of Search ..... 81/177.1, 177.4, 81/177.7, 440, 124.5, 177.6

(56) References Cited

U.S. PATENT DOCUMENTS 2,726,695 * 12/1955 Malm ..... 81/440
4,000,767 * 1/1977 Geng ..... 81/177.6 X
4,748,874 * 6/1988 Sharp et al. ..... 81/177.7 X

* cited by examiner

*Primary Examiner*—James G. Smith
(74) *Attorney, Agent, or Firm*—Cristina M Offenberg

(57) ABSTRACT

A multi-purpose hand tool which includes a handle body with a plurality of drive tools mounted on an axis at one end allowing various tools such as hex tools, screwdriver tools, torx tools and others to rotate for use. Pivoting folding wingbars are affixed to the handle by an axis to give additional torque to the drive tools. At the opposite end of the drive tools in the handle is a square opening to receive various independent hand and power ratchet drives. The tool incorporates lifting levers which are affixed to the handle by an axis. The levers when depressed toward the folding tool will lift the drive tools away from the handle to provide easier selection of a particular drive tool. A second embodiment has a ratchet mechanism assembly with two folding wingbars which eliminate the need for an independent ratchet handle or driver.

7 Claims, 4 Drawing Sheets

FOLDING TOOL

BACKGROUND OF THE INVENTION

Typical prior art folding hex sets have hex drive tools which fold over each other pivoting out from the opposite ends of a handle. With many prior art tools, the longer drive tools are attached at one end of a handle and overlap the generally shorter tools attached at the opposite end of the handle. The folding tool of the present invention positions all drive tools at one end of a cylindrically shaped handle so that the drive tools can be deployed by means of a lifting lever. This allows an operator to select the specific drive tool required. This advantage allows an operator to select the exact drive tool needed without having to rotate all the drive tools from and back into the storage positions. With the lifting lever, an operator eliminates having to dig his fingers into the ends of the tools, which are folded against the handle. Digging an operators fingers into the tool can be difficult if the fingers or hands are wet or slippery and could conceivably cause injury to the finger or hand if the drive tools are sticky or difficult to remove.

In many of the prior art devices, when a user wishes to use one of the smaller drive tools, the overlapping larger drive tools must be rotated out of the storage position to gain access to the smaller drive tool. Once the smaller tool is selected, then the smaller drive tools and the larger drive tools must be rotated back into the storage position before the smaller drive tool can be utilized.

With existing prior art hex tools, one cannot obtain much torque with the drive tool in a full open operating position. Most prior art is utilized with the drive tool opened in a 90 degree position relative to the handle. This thereby limits the use of the prior art hex tools in tight work areas. The folding tool of the present invention can be used in tight work areas with the tool opened 180 degrees relative to the handle with either one or two wingbars in a 90 degree open position. The wingbars provide additional torque to the drive tool when the operator applies force to one or both of the wingbars.

An additional feature shows a square hole for a hand or power ratchet drive in one end of the tool, thereby increasing the drive speed and torque advantage for the tool. Using a ratchet also provides quick and easy tightening and loosening of fasteners. This too is a significant advantage over the prior art.

A second embodiment shows a ratchet mechanism assembly which includes interconnected wing bars and ratcheting mechanism. In this embodiment, no separate ratchet is needed. The operator can extend one or both wingbars and ratchet the tool to rotate the selected drive tool.

SUMMARY OF THE INVENTION

The present invention provides operating advantages by placing all drive tools at one end of a cylindrically shaped handle. A variety of drive tools in the folding tool can be used such as hex wrenches, screwdrivers, torx drives, cross point socket tools and others. This list is meant to be exemplary and not limiting. Any type of tool that is on a handle could be used in conjunction with the embodiments disclosed such as sockets, hole punches, pick magnets, spark plug gapping tools, small brushes, abrasive tool ends and others.

The positioning of the drive tools at one end allows easy access to all drive tools especially when utilizing the lifting lever. The lifting lever eliminates having to dig your fingers into the folding tool set to retrieve the appropriate drive tool.

Digging a users fingers into a cavity full of tools can cause an injury to the end of a users finger. This can also be time consuming and frustrating if the drive tools are difficult to rotate from the tool cavity. If the user's fingers or hands have a lubricant or liquid on them, this too can make the removal of the drive tool difficult enhancing the possibility of injury. If an operator's hands are dirty or greasy, this embodiment eliminates handling all the drive tools and keeps the drive tools cleaner.

The folding tool of the present invention has two pivoting wingbars that can be deployed for additional leverage. Located at one end of cylindrical handle is a square opening for independent hand or power ratchet drives.

The second embodiment incorporates a ratchet mechanism assembly with attached collapsible wingbars permanently attached to the tool handle. The wingbars can be deployed lor additional torque and also provide a ratcheting action for driving the folding tool. This second embodiment of the tool with the attached ratchet assembly eliminates having to carry an independent ratchet to drive the tools, saving room and weight in the tool kit or bag. This second embodiment also provides faster operation of the drive tool as the operator does not need to spend additional time seeking the possibly lost or misplaced ratchet drive.

DETAILED DESCRIPTION OF THE INVENTION

Figure 1:
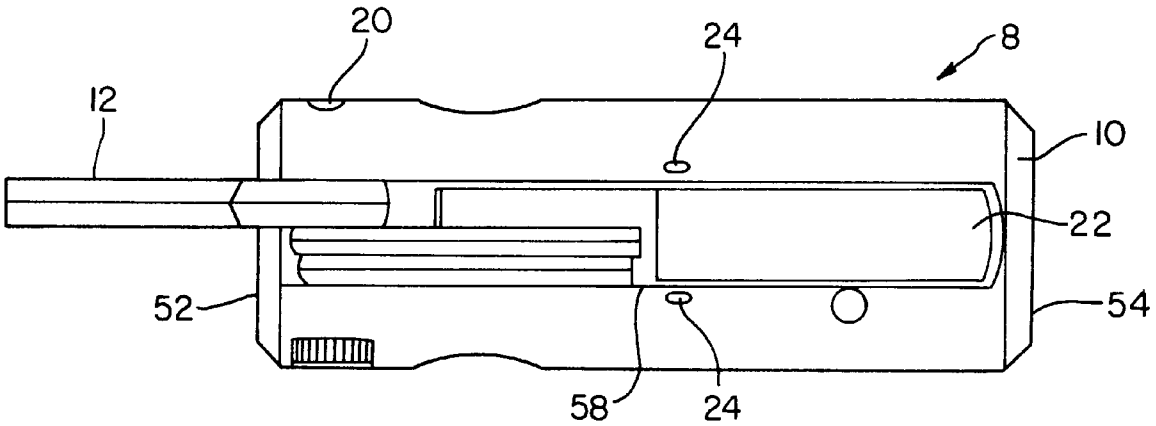
FIG. 1 is a perspective view of a first embodiment of the folding tool with one drive tool in an open position.

Referring to FIG. 1, this folding tool 8 is comprised of a cylindrical shaped handle 10, which can be made of plastic, metal, wood, composites and steel. Handle 10 has at least one lever slot 58 in the surface of the handle running parallel to a longitudinal axis. Lever slot 58 houses the drive tools 12 and the lever 22.

Figure 6:
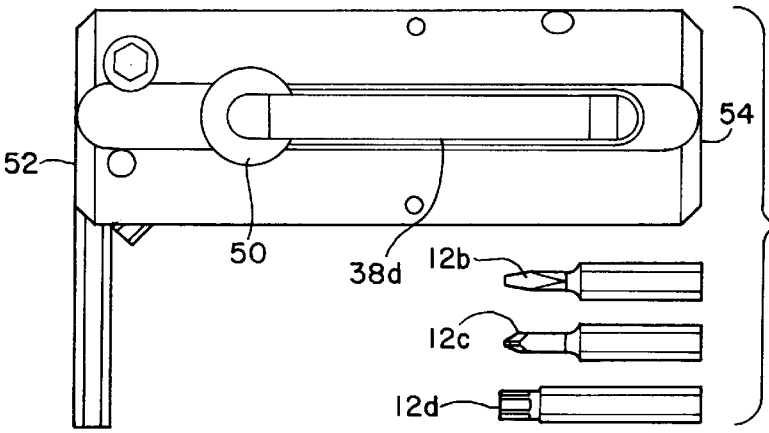
FIG. 6 is a side view of the first embodiment of the folding tool with a drive tool in the 90-degree position.

Handle 10 is provided with a number of different types of drive tools 12 such as hex drive 12*a*, or other types of drive tools such as slotted screwdriver 12*b*, phillip head screwdrivers 12*c*, or torx driver 12*d*, FIG. 6. These drive tools 12 and others can be used to engage various types of fasteners such as hex fasteners, slotted screw fastener, phillip head fastener, torx head fastener and others. The folding tool 8 could have a combination of drive tools or various sized drive tools of the same type. For example, the folding tool 8 could have a slotted screwdriver, phillip head screwdriver and punch, or as a second example, have a small medium and large phillip head screwdriver.

Figure 3:
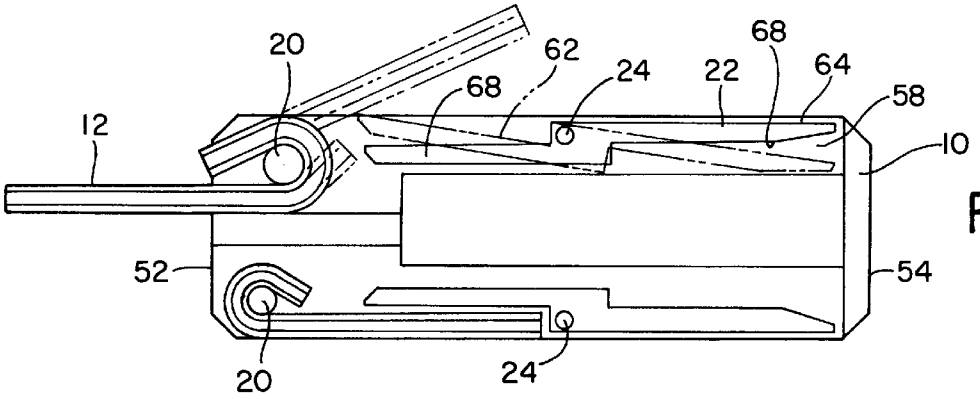
FIG. 3 is a longitudinal cross section of the first embodiment of the folding tool showing rotation of the lifting lever.

The drive tools 12, are mounted to handle 10 at a first end 52 and rotate on axis 20 into and out of lever slot 58 allowing for easy deployment of the drive tools 12. FIG. 3, shows a lifting lever 22 fastened to handle 10 on axis 24 and housed in the closed position within lever slot 58. Lifting lever 22 can be depressed toward handle 10 and rotating on axis 24, such that the first surface 66 of the lifting lever 22 engages bottom of lever slot 58, FIG. 3. When this occurs, the drive tool surface 62 then engages and lifts the drive tools 12 from the lever slot 58. Lifting lever 22 pushes the drive tools 12 away from the handle 10. This allows drive tools 12 to be easily and relatively effortlessly selected.

When the user has selected the drive tools 12 to use, the remaining drive tools 12 can be pushed back into the lever slot 58 where they engage the drive tool surface 62 of lifting lever 22. This causes the lifting lever 22 to rotate back into the lever slot 58. The lifting lever 22 stops rotation when the second surface 68 touches the bottom of the lever slot 58.

By positioning the drive tools 12 at the first end 52 of the handle 10, a square opening 26 (shown in FIG. 4), positioned at a second end 54, of the handle 10 can receive independent hand and power ratchet drives, (not shown). These ratchet drives can be used with folding tool 8 causing quicker turning action and more torque when engaging various fasteners such as hex fastener, slotted screw fastener, phillip head fastener, torx head fastener and others.

Figure 2:
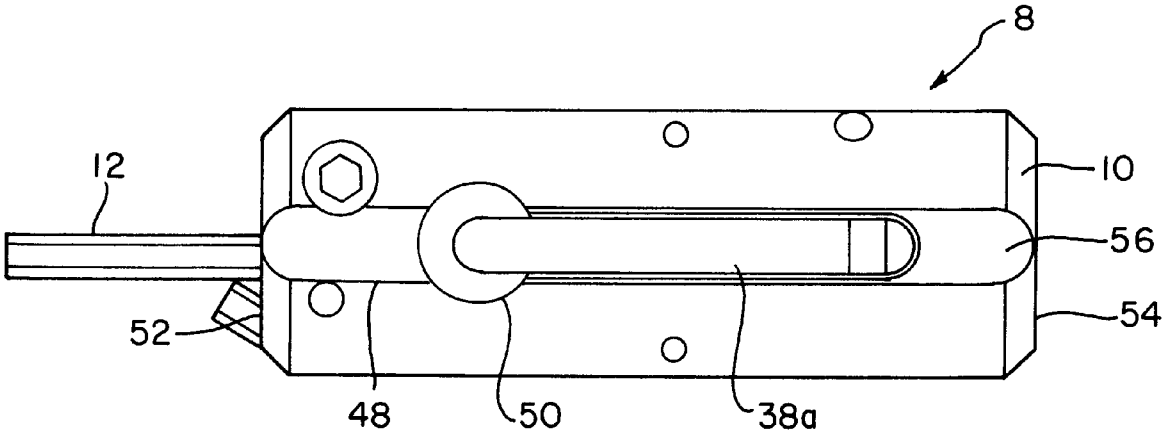
FIG. 2 is a perspective view of the first embodiment of the folding tool with one drive tool in an open position and the body of the tool rotated showing the wingbars in a closed position.
Figure 4:
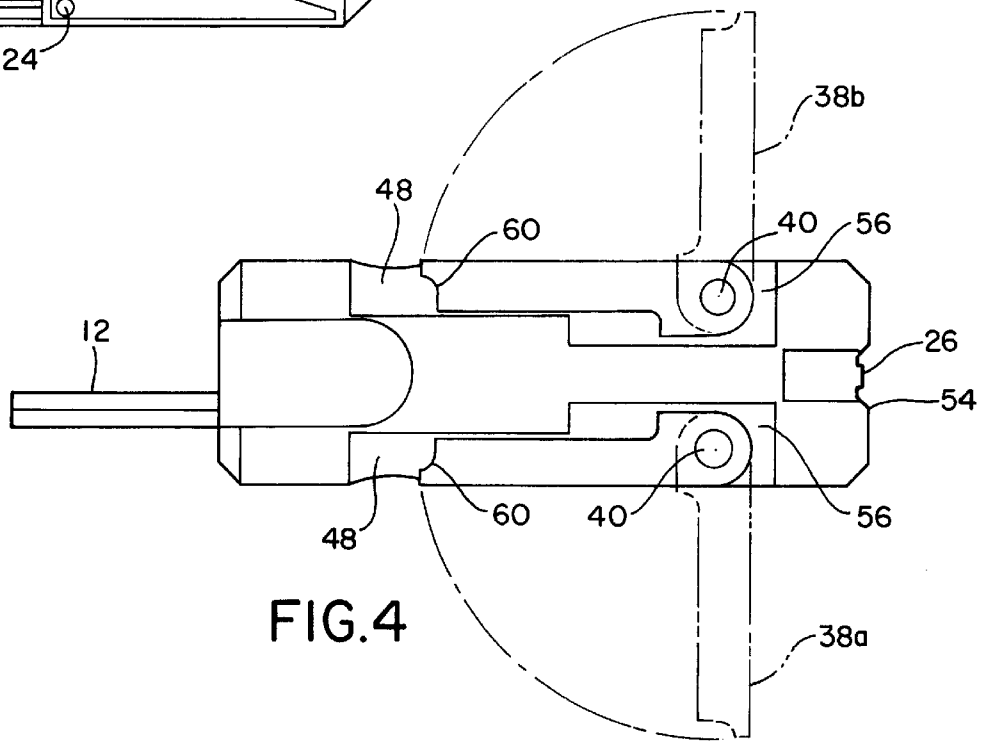
FIG. 4 is a longitudinal cross section view of the first embodiment of the folding tool showing rotation of the wingbars in the closed position.

Adjustable first and second wingbars 38*a* and 38*b*, FIGS. 2, 4, are affixed to handle 10 on a pivot 40. First and second wingbars 38*a* and 38*b* can be manually rotated or deployed from within a bar slot 56 in the handle 10. When deployed, this forms a T-shaped handle for additional torque when using the folding tool 8 as shown in FIG. 4. To deploy the first and second wingbars 38*a* and 38*b* from within the bar slot 56, a user inserts a finger into the tapered slot 48 and is guided into the bar access depression 50. The finger then engages the tapered tip 60 of the first wingbar 38*a* and pulls the first wingbar 38*a* from within the bar slot 56. The wingbars do not need to be fully 90 degrees from the handle 10 to gain a mechanical advantage. It is not necessary that both wingbars 38*a* and 38*b* be deployed to gain a mechanical advantage. In tight work areas, only wingbar 38*a* or 38*b* may be deployed to provide the mechanical advantage.

Figure 5:
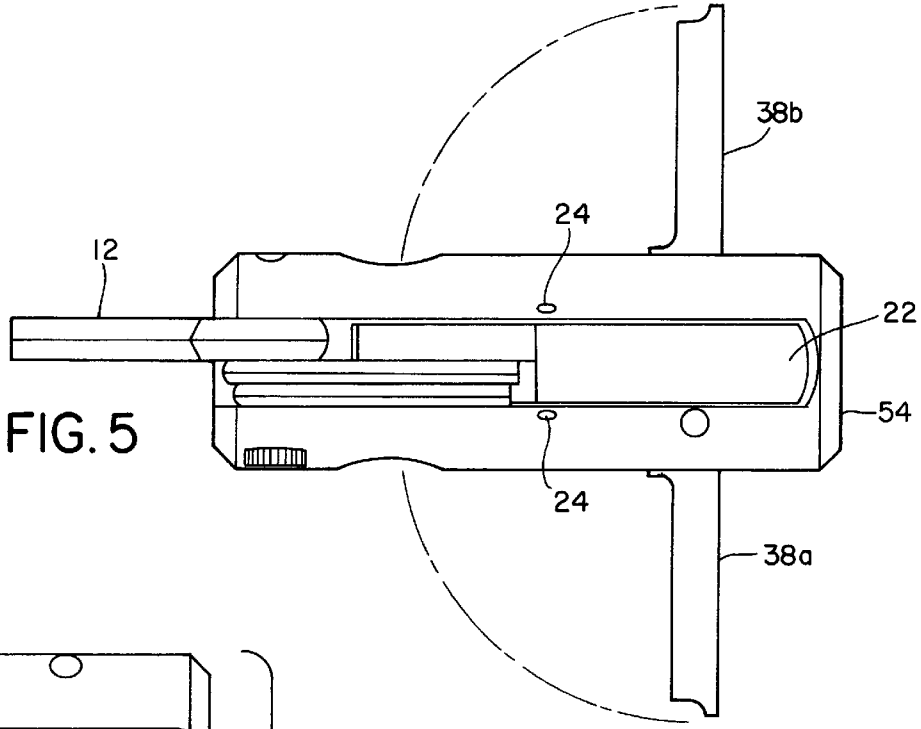
FIG. 5 is a side view of the first embodiment showing the wingbars in the open position.

To operate the folding tool 8 in FIG. 1 and FIG. 3, the operator pushes the lifting lever 22 toward the handle 10 where the first surface 66 contacts the bottom of lever slot 58. The drive tool surface 62 contacts drive tools 12 which are rotated away from the handle 10. The operator can easily select the desired drive tool to use. The operator can use handle 10, FIG. 3 and FIG. 6 with the tools 12*a*, 12*b*, 12*c*, 12*d* in the 180 degree deployed position FIG. 5 or the 90 degree deployed position, FIG. 6, or any angle in between. The operator can then deploy the first and second wingbars 38*a* and 38*b* to form a T-bar configuration, FIG. 4, providing folding tool 8 additional tightening and loosening torque.

Additional speed and leverage can be obtained by using an independent hand or power ratchet, (not shown), which can be inserted into square opening 26 in handle 10, FIG. 4. The hand or power ratchet can likewise be used to increase the mechanical advantage or speed of installation or removal or both the mechanical advantage and speed.

Figure 7:
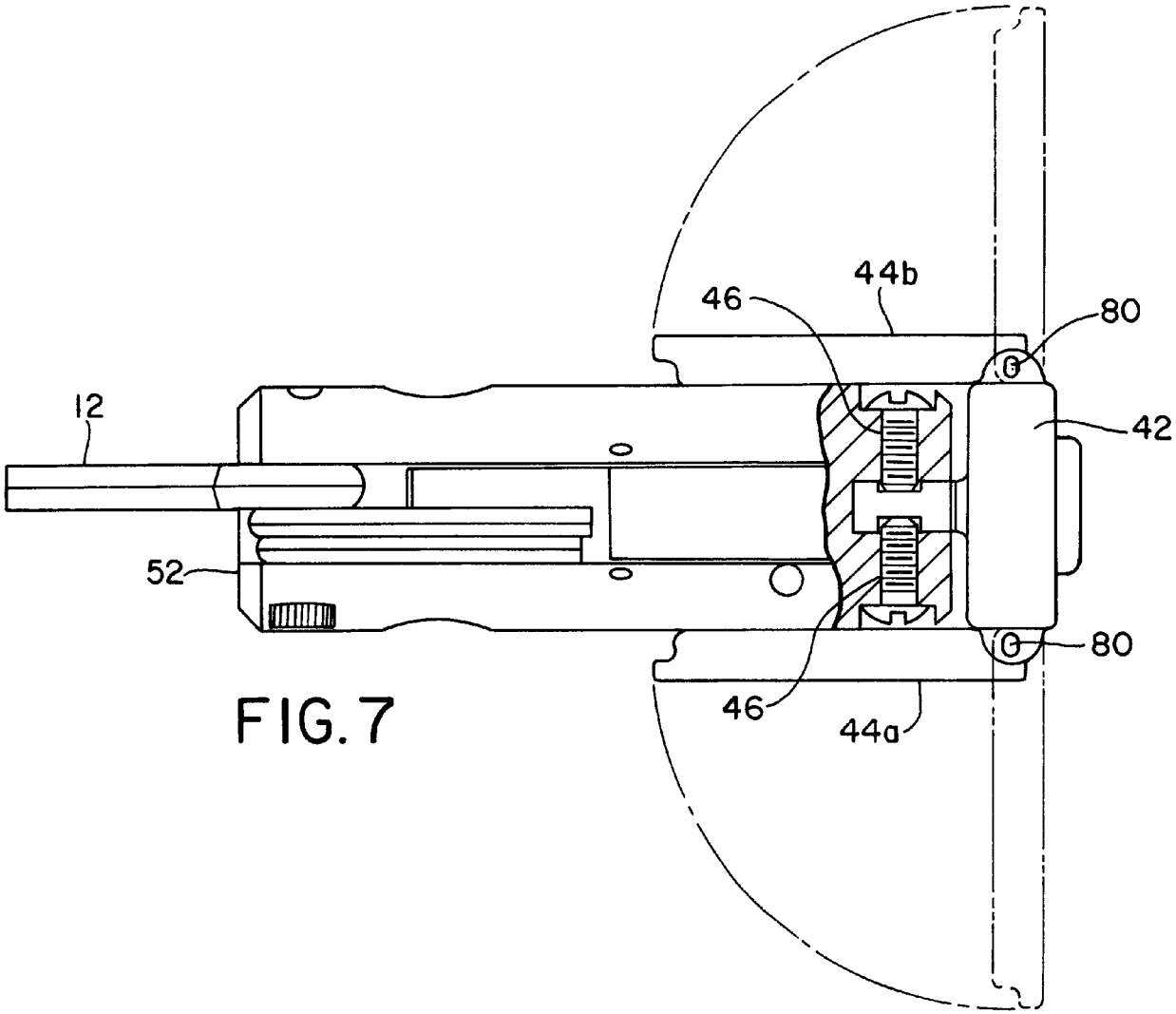
FIG. 7 is a side view of the second embodiment of the folding tool with one drive tool in the 180 degree opened position and partial cross section of the ratchet mechanism assembly with wingbars in the closed position.

A second embodiment of the folding tool, FIG. 7, incorporates a ratchet mechanism assembly 42, by means of screws and rivets 46, FIG. 7. The first and second folding wingbars 44*a* and 44*b* affixed via axis 80 are attached to ratchet mechanism assembly 42 allowing an operator to use a ratchet mechanism which is an integral part of handle 10. This embodiment eliminates the need for an independent ratchet drive as the ratchet mechanism is included with the folding tool 8.

The construction and configuration of the folding tool gives the operator a comfortable operating tool with time saving component parts and accessories that make for faster and easier operation. In addition, the second embodiment eliminates the need for a separate ratchet tool by including the ratcheting mechanism in the tool itself Other advantages of this present invention will be easily apparent to a person skilled in the art.

T-HEX Hand Tool Parts Number List—April, 1999
FOR REFERENCE PURPOSES

| Part Number | Description |
|---|---|
| 8 | Folding Tool |
| 10 | Cylindrical Shaped Handle |
| 12 | Drive Tools |
| 12a | Hex Drive Tool |
| 12b | Slotted Screwdriver Tools |
| 12c | Phillip Head Screwdriver Tools |
| 12d | Torx Read Tools |
| 20 | Axis For Drive Tools |
| 22 | Lifting Lever |
| 24 | Fastener/Pivot Axis |
| 26 | Square Opening |
| 30 | Hex Fastener |
| 32 | Slotted Screw Fastener |
| 34 | Phillip Head Fastener |
| 36 | Torx Head Fastener |
| 38a | First Wingbar |
| 38b | Second Wingbar |
| 40 | Wingbar Pivot |
| 42 | Ratchet Mechanism Assembly |
| 43 | Ratchet Mechanism Drive Pin |
| 44a | First Folding Wingbar |
| 44b | Second Folding Wingbar |
| 46 | Ratchet Mechanism Assembly, Screw and Rivet Pins |
| 48 | Tapered Slot |
| 50 | Bar Access Depression |
| 52 | First End of Handle |
| 54 | Second End of Handle |
| 56 | Bar Slot |
| 58 | Lever Slot |
| 60 | Tapered Tip of Wingbar |
| 62 | Drive Tool Surface of Lifting Lever |
| 64 | Contact Surface of Lifting Lever |
| 66 | First Surface of Lifting Lever |
| 68 | Second Surface of Lifting Lever |
| 70 | Rotation End of Wingbar |
| 72 | Free End of Wingbar |
| 74 | Right/Left Selector for Ratchet |
| 80 | Folding Wingbar axis |

I claim:

1. A mechanical hand tool comprising:

a cylindrical handle having a first end and a second end and an outer surface;

a drive tool being pivotably attached to said first end for selectively deploying said drive tool in an operational mode from a stored position in which said drive tool lies alongside said handle in a lever slot to an operative position in which said drive tool extends beyond said first end of said handle, wherein said lever slot is located in the outer surface of the handle adapted to house a lifting lever which is rotably attached near said second end of the handle, wherein said lifting lever comprises a drive tool surface end and a contact surface end on the upper surface and a folding tool surface on the under surface wherein the lifting lever is operational by depressing said contact surface end to rotate said drive tool toward the operative position;

a bar slot in the outer surface of said handle extending from near said first end towards said second end, the bar slot housing a wingbar, the wingbar pivotally attached to said handle at a rotation end of said wingbar and having a free end opposite said rotation end and adapted to be deployed between a storage position substantially parallel to the longitudinal axis of said handle and an operative position outwardly and laterally extending from said handle.

2. The hand tool of claim 1 further comprising:

a square opening in the second end of the handle for engaging a ratchet driver.

3. The hand tool of claim 1 further comprising:

said handle having a second bar slot displaced approximately 180 degrees from said bar slot wherein said second bar slot houses a second wingbar.

4. The hand tool of claim 1 further comprising:

said handle having a second lever slot displaced approximately 180 degrees from said lever slot housing a second lifting lever and housing at least one additional drive tool.

5. The hand tool of claim 1 further comprising:

said bar slot having a tapered slot end and adjacent bar access depression on the end near the first end of said handle.

6. The wingbar as claimed in claim 1 having a tapered tip on said free end.

7. The hand tool of claim 1 further comprising:

a plurality of drive tools housed in the lever slot of the handle.

* * * * *